US007906046B2

(12) United States Patent
Sokol et al.

(10) Patent No.: US 7,906,046 B2
(45) Date of Patent: Mar. 15, 2011

(54) ANTIOXIDANT JOINT COMPOUND AND METHOD FOR FORMING AN ELECTRICAL CONNECTION

(75) Inventors: Robert L. Sokol, Orland Park, IL (US); Christopher R. Haczynski, Crown Point, IN (US)

(73) Assignee: Panduit Corp., Tinley Park, IL (US)

( * ) Notice: Subject to any disclaimer, the term of this patent is extended or adjusted under 35 U.S.C. 154(b) by 395 days.

(21) Appl. No.: 12/062,824

(22) Filed: Apr. 4, 2008

(65) Prior Publication Data

US 2009/0250508 A1 Oct. 8, 2009

(51) Int. Cl.
*H01B 1/02* (2006.01)

(52) U.S. Cl. ..... 252/518.1; 174/66; 174/92; 252/512; 252/513; 252/514; 210/490

(58) Field of Classification Search ..... 252/511, 252/512, 513, 514, 518.1; 174/66, 92; 210/490
See application file for complete search history.

(56) References Cited

U.S. PATENT DOCUMENTS

| | | | | |
|---|---|---|---|---|
| 2,815,497 | A | 12/1957 | Redslob | |
| 2,818,346 | A | 12/1957 | Gossman | |
| 2,869,103 | A | 1/1959 | Wells | |
| 2,901,722 | A | 8/1959 | Arnott, Jr. | |
| 2,906,987 | A | 9/1959 | Fox, Jr. | |
| 2,951,110 | A | 8/1960 | Matthysse et al. | |
| 3,157,735 | A | 11/1964 | Stroup et al. | |
| 3,275,738 | A | 9/1966 | Flynn et al. | |
| 3,833,513 | A | 9/1974 | Fath | |
| 3,895,851 | A | 7/1975 | Bolton et al. | |
| 3,916,517 | A | 11/1975 | Luongo | |
| 4,214,121 | A | 7/1980 | Charneski et al. | |
| 4,312,793 | A | 1/1982 | Charneski et al. | |
| 4,596,670 | A * | 6/1986 | Liu | 252/511 |
| 4,784,707 | A | 11/1988 | Wefers et al. | |
| 5,090,923 | A | 2/1992 | Kenyon et al. | |
| 5,326,636 | A | 7/1994 | Durand et al. | |
| 6,479,763 | B1 | 11/2002 | Igaki et al. | |
| 6,533,963 | B1 | 3/2003 | Schleifstein et al. | |
| 6,733,308 | B2 | 5/2004 | Jedlitschka | |
| 6,942,529 | B2 | 9/2005 | Fujimoto et al. | |
| 2002/0074282 | A1 * | 6/2002 | Herrmann et al. | 210/490 |

* cited by examiner

*Primary Examiner* — Mark Kopec
*Assistant Examiner* — Khanh Tuan Nguyen
(74) *Attorney, Agent, or Firm* — Robert A. McCann; Christopher S. Clancy

(57) ABSTRACT

A joint compound for electrical connections is disclosed which includes an antioxidant base material and a quantity of stainless steel grit mixed with the antioxidant base material to provide improved mechanical pullout strength. The joint compound has a weight ratio of antioxidant to stainless steel grit in the range of from about 30:70 to about 90:10, preferably, from about 40:60 to about 70:30, and more preferably about 50:50. The stainless steel grit is cut wire having a diameter within the range of from about 0.012 inches to about 0.125 inches, with a preferred diameter within the range of from about 0.012 inches to about 0.030 inches, and 0.017 inches being a more preferred stainless steel grit diameter.

10 Claims, 3 Drawing Sheets

ANTIOXIDANT JOINT COMPOUND AND METHOD FOR FORMING AN ELECTRICAL CONNECTION

FIELD OF THE INVENTION

The present device relates to an antioxidant joint compound for use on power and grounding wires. Particularly, the present device relates to an antioxidant compound which improves the mechanical pullout strength of components held in electrical contact via a metal compression connector.

BACKGROUND OF THE INVENTION

Generally speaking, when two electrical components are connected together, it is important that the connection be strong to prevent accidental pullout of such components. This is particularly difficult to achieve with underground connections due to the fact that they are hidden underground and require an antioxidant compound to counteract against the corrosive tendencies of moist soil. Some such antioxidants are oil based and provide as much of a lubricating property as an antioxidizing property to the connection.

Others, such as disclosed in U.S. Pat. Nos. 4,312,793 and 4,214,121 to Charneski et al., prefer to use a thermosetting hardenable resin, such as all epoxy or polyester, to solidify a connection. How ever, such hardening resins can be costly and often present other appreciable difficulties (e.g., exact mixing of ingredients, exothermic reaction) for those in the field preparing such connections.

Another approach has been to texturize the component surface by pre-crimping the attachment surface or knurling, for example, a grounding rod. In both cases, the use of extra tooling by those in the field only serves to unnecessarily complicate the connecting process.

For all such connections, it is desirable to increase the rotational and/or pullout strength between the connecting components (e.g., a wire and a rod) and the connector without additional time or steps. Such connections should be capable or complying with UL 467, UL 486 and IEEE 837 (2002) test standards to ensure prolonged satisfactory performance.

It is further desirable to penetrate any pre-existing dirt or corrosion present on the mating surfaces of the components, including the connector, to create a conductive pathway. Finally, it is also desirable to prevent moisture ingress and oxidation of the crimped connection for an extended period of time.

These and other problems of the prior art, as well as these and other desired goals of a proper joint compound for an electrical connection, are addressed by the invention of this application.

SUMMARY OF THE INVENTION

There is disclosed herein an improved joint compound and a method for forming an electrical connection using the joint compound which avoids the disadvantages of prior devices while affording additional structural and operating advantages.

A joint compound for electrical connections is disclosed which comprises an antioxidant base material and a quantity of stainless steel grit mixed with the antioxidant base material to provide improved mechanical pullout strength.

In an embodiment of the preferred joint compound the ratio, by weight, of antioxidant to stainless steel grit is in the range of from about 30:70 to about 90:10. Preferably, the ratio, by weight, of antioxidant to stainless steel grit is in the range of from about 40:60 to about 70:30, and more preferably the ratio, by weight, of antioxidant to stainless steel grit is about 50:50.

In an embodiment of the preferred joint compound the stainless steel grit is cut wire having a diameter within the range of from about 0.012 inches to about 0.125 inches. Preferably, the grit particles have a diameter within the range of from about 0.012 inches to about 0.030 inches, and more preferably the stainless steel grit has a diameter of about 0.017 inches.

In a preferred method, a connection between two electrical components is formed by preparing a joint compound comprised of an antioxidant base material and stainless steel grit, providing a suitable connector for electrically coupling the components and applying the joint compound to mating surfaces of either the connector, the components to be coupled together, or both. The connector is then crimped to the components such that the joint compound is sandwiched between mating surfaces of the components.

It is an aspect of the method that the crimping includes sufficient force to cause the stainless steel grit of the joint compound to penetrate the mating surfaces of the components. The penetration should be such that mechanical pullout strength of the components from the connector is improved over a similar connection made between similar components using an oil based antioxidant without stainless steel grit.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
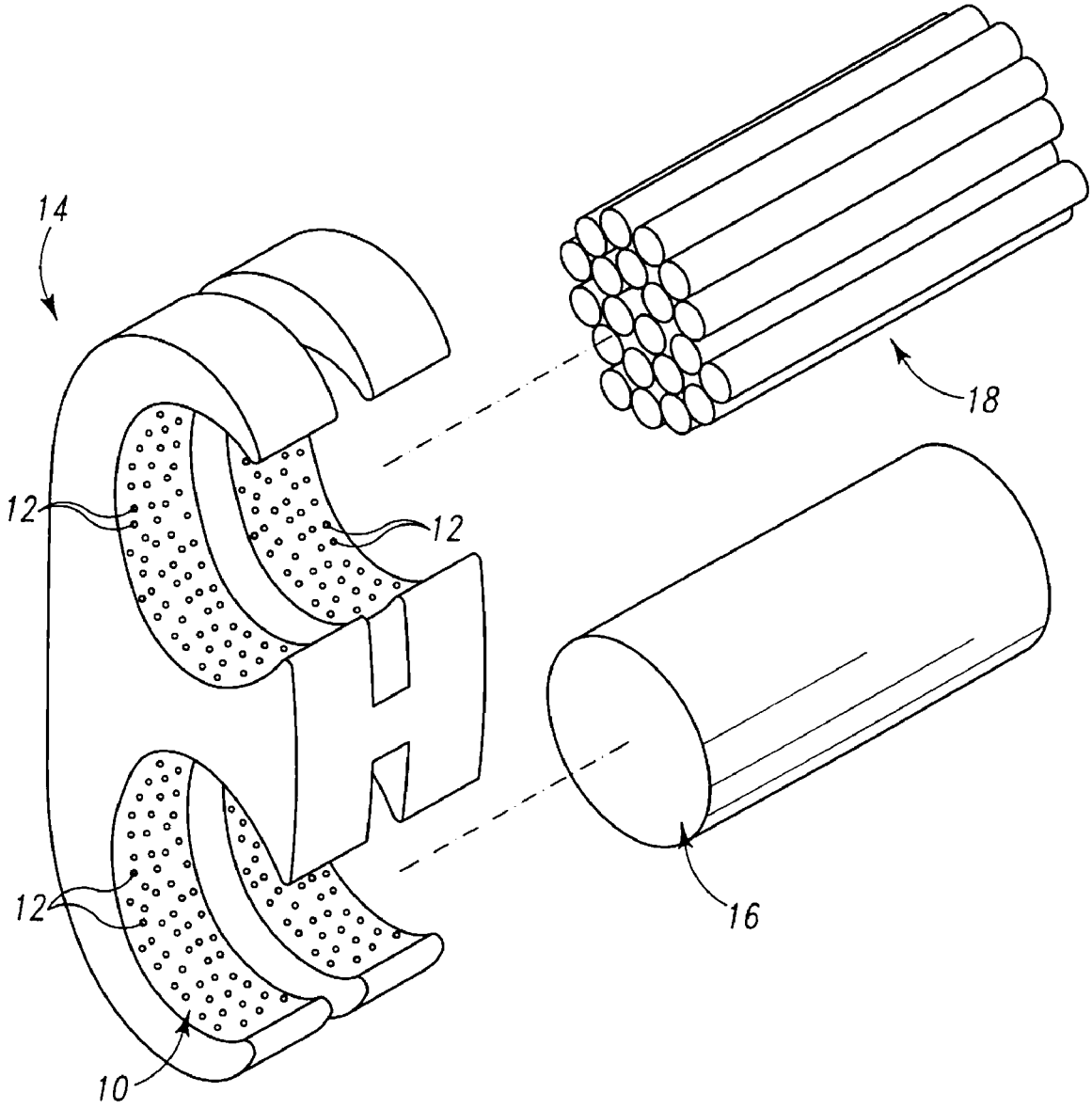
FIG. 1 is a perspective view of an uncrimped electrical connection which may benefit from the use of an embodiment of the present joint compound.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2:
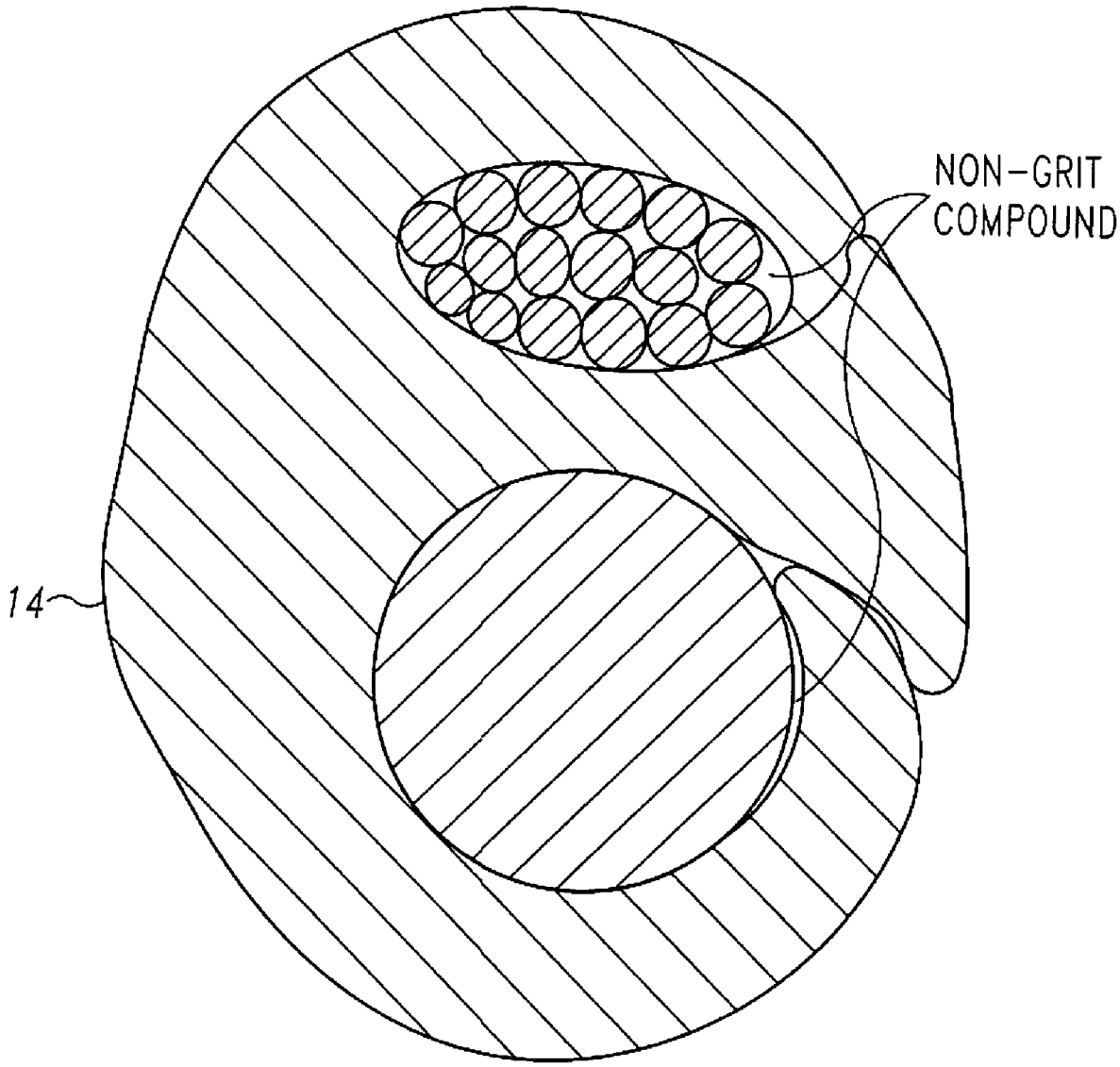
FIG. 2 is a cross-section of a crimped electrical connection using a prior art joint compound.
Figure 3:
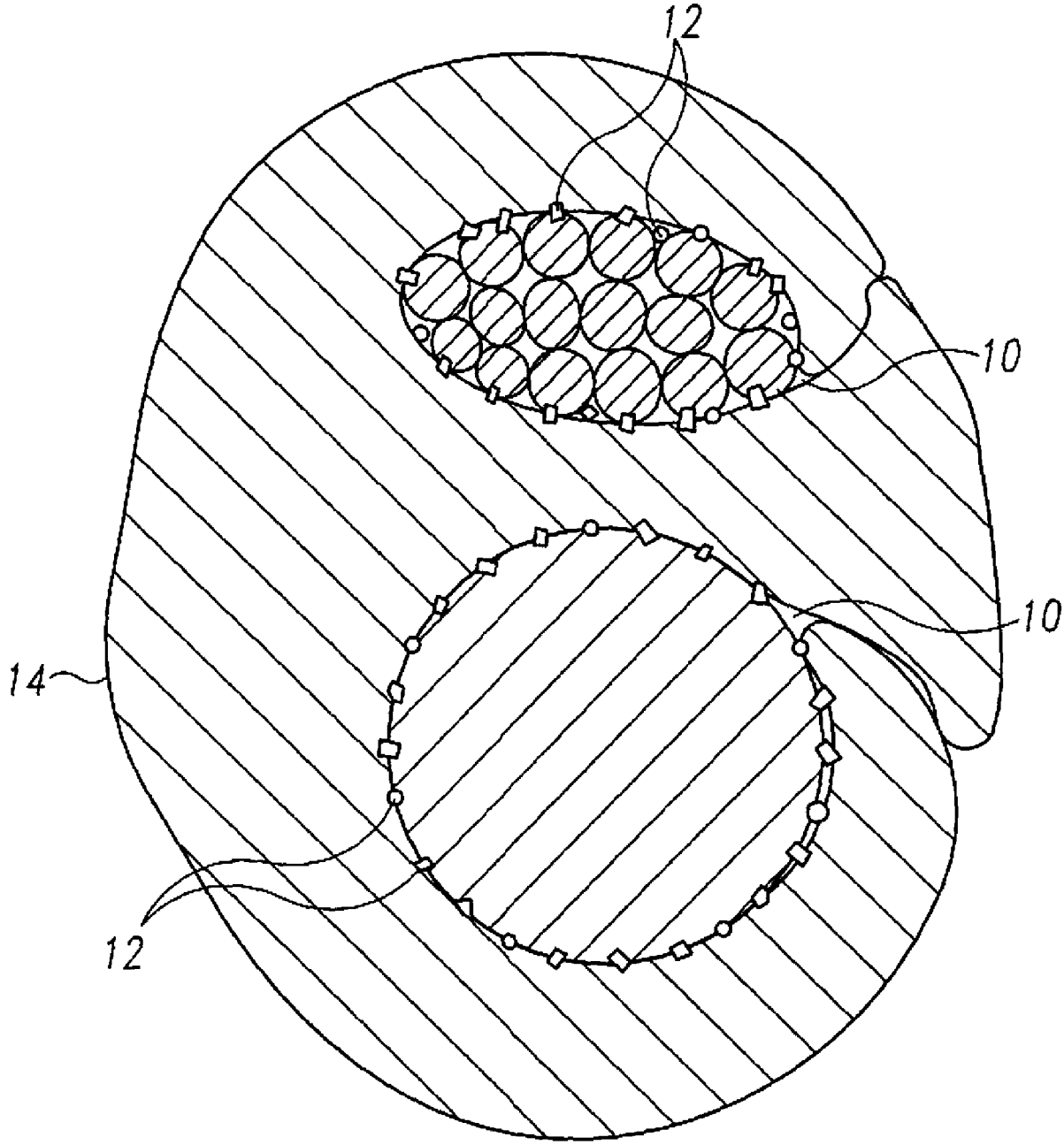
FIG. 3 is a cross-section of a crimped electrical connection using an embodiment of the present joint compound.

Referring to FIGS. 1-3, there is illustrated an antioxidant joint compound used for electrical connections and having stainless steel grit therein, generally designated by the numeral 10. The compound 10 is illustrated and described herein as used with connectors designed and manufactured by the assignee of the present application. Panduit Corp. of Tinley Park, Ill. Particularly, the following description and drawings refer to the use of a GCE 500-250 E-Tap or a HTCT 250-250 H-Tap connector. However, the compound 10 may be used with many other connectors in the industry with similar improved mechanical pullout strength without the sacrifice of conductivity or corrosive resistance.

Similarly, while a grounding connection between a grounding rod and an electrical wire strand is predominately described below and illustrated in the appended drawing figures, it is understood that other electrical components similarly connected using a joint compound would benefit by the claimed invention. Such connections may be power or grounding connections and may comprise wire to wire, wire to grounding rod, wire to rebar, and any other similar electrical connection configurations.

The preferred compound 10 is an oil based material which incorporates a hard "grit like" additive 12 and is typically pre-applied to the mating surfaces of the connector prior to installation. It is preferred that the grit 12 material be conductive and be capable of penetrating any existing dirt or corrosion on the mating surfaces to create a proper conductive pathway. The particles should also be sufficiently large to create a mechanical lock between the connector and the ground rod and wire. Such mechanical lock enhances the rotational and pullout strength of the connection. The antioxidant compound, comprised of urethane polymer of castor oil with fumed silica as a thickener and about 6.5%, by weight, copper flake for enhanced conductivity, flows into any voids during crimping to seal the connection from moisture ingress and prevent future oxidation.

There are many commercially available antioxidant joint compounds on the market. Some incorporate grit like fillers such as silicon carbide where mechanical performance enhancement is desired. None, however, provide the high level of mechanical performance enhancement needed for grounding grid connections.

Accordingly, the grit material 12 used for the present invention is a commercially available stainless steel cut wire shot. Stainless steel is a strong material and is also corrosion resistant and (mildly) electrically conductive. The grit 12 is available in sizes ranging from 0.012" to 0.125" diameter, and is typically used for peening, cleaning, tumbling and vibratory finishing. Preferred diameters fall within the 0.012" to 0.030" range, with 0.017" being the most preferred.

The grit 12 is preferably cut into lengths approximately equal to the wire diameter, though variations between the diameter and cut length (e.g., 2:1 or 1:2 ratio) to suit different conditions of use would be readily understood by those skilled in the art. The cut ends of the wire are preferably "as cut" which are sharp and have excellent surface penetration ability.

In preparing the joint compound an oil based antioxidant, such as urethane polymer of castor oil, is mixed with a quantity of grit 12. The antioxidant may also include a thickener, such as fumed silica, and a conductivity enhancing additive, such as copper flake, the latter being added in an amount within the range of from about 2% to 10%, by weight.

The amount of grit 12 can vary to suit the particular use. Tests have shown that a 50/50 antioxidant to grit ratio, by weight, works well. However, ratios anywhere from 90:10 to 30:70 may have uses in the industry. The size and amount of stainless steel grit used can be varied to optimize performance for specific applications.

TABLE I

| Mechanical Pullout Force (lbs) | | | | |
|---|---|---|---|---|
| SAMPLE | A | B | C | D |
| 1 | 322 | 256 | 1148 | 1456 |
| 2 | 201 | 256 | 1096 | 1225 |
| 3 | 269 | 238 | 1133 | 1527 |
| Avg. | 264 | 250 | 1126 | 1403 |

A - no antioxidant and no grit (Comparative Example)
B - antioxidant, but no grit (Comparative Example).
C - antioxidant with 100 mesh silicon carbide grit (50/50) (Comparative Example).
D - antioxidant with 0.017" stainless steel grit (50/50).

Examples A, B, C and D were prepared using a ¾ copper bonded steel ground rod, 4/0 stranded copper wire (19 strands), and a GCE 500-250 E-Tap connector made by Panduit Corp. of Tinley Park, Ill. The rod and wire components were bound to the properly prepared connector using a single crimp applied by a CT-2931 12 Ton Crimp Tool with PG-50 Die Index Crimp Dies, also made by Panduit. Examples A, B and C are comparative examples, as set forth above.

In Examples B, C and D, where an antioxidant was used (with or without grit material), the antioxidant was applied as a thin layer to the inner surfaces of the connector before crimping to either the wire or rod components. The antioxidant used was an oil based compound manufactured by Continental Products, part no. X-1432 with 10% copper flake. The grit was added to the antioxidant to produce a 50/50 mixture, by volume. No compound was applied to Example A. After applying the noted compound to Examples B, C and D, the components in all four Examples were uniformly crimped together. Using a load measuring device, the rod and wire components were then pulled apart to measure peak load (lbf) before failure (rod pullout of connector for all samples).

As shown in Table I, the use of antioxidant on the connector (Example B) caused a slight decline in the mechanical pullout strength over Example A. Such result was not unexpected, because the antioxidant is essentially an oily lubricant. However, the use of antioxidant and grit (Examples C and D) provided a 4.5 to 6 fold increase in mechanical pullout strength over Example A. Most impressively, Example D (stainless steel grit) provided a nearly 25% increase in mechanical pullout strength over currently available commercial products using a silicon carbide grit.

FIG. 1 illustrates how the grit 12 resides throughout the compound 10 as it is applied to the mating surface of the connector 14. Before crimping, the compound 10 surrounds the rod 16 and the wire 18. During crimping, at least some of the grit 12 penetrates the mating surfaces of both the connector 14 and the rod 16. Other particles of the grit 12, which may not penetrate the mating surfaces, assist in creating a strengthened mechanical bond by binding the rod 16 within the crimped connector 14.

One reason for the improved mechanical pullout strength of larger diameter grit over smaller diameter grit may be due to this binding action between the mating surfaces. The larger diameter particles, to a certain degree, may tend to create greater binding action than smaller diameter particles. So, while the larger diameter grit particles may not penetrate the mating surfaces any more than the smaller diameter particles, an appreciable increase in mechanical pullout force is exhibited by the larger diameter grit particles.

However, beyond the certain maximum, which Applicants contend is about 0.030" diameter, erratic results may be produced. Such inconsistency may be caused by a substantial decrease in contact between the mating surfaces where larger diameter particles are used.

Three additional stainless steel grit diameters were tested, and produced similar improved results over Example C, as shown in Table II below.

TABLE II

| Mechanical Pullout Force (lbs) | | | |
|---|---|---|---|
| SAMPLE | E | F | G |
| 1 | 1390 | 1596 | 1623 |
| 2 | 1601 | 1604 | 1684 |
| 3 | 1519 | 1645 | 1702 |
| Avg. | 1503 | 1615 | 1670 |

E - antioxidant with 0.014" diameter stainless steel grit (50/50).
F - antioxidant with 0.020" diameter stainless steel grit (50/50).
G - antioxidant with 0.028" diameter stainless steel grit (50/50).

Examples D, E, F and G each conforms to the strict standards set forth in UL 467, UL 486 and the IEEE 837 (2002) test standards for such grounding connectors incorporating an antioxidant.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A joint compound for electrical connections, the compound comprising:

an antioxidant base material; and a quantity of stainless steel grit mixed with the antioxidant base material, wherein the ratio, by weight, of antioxidant to stainless steel grit is in the range of from about 30:70 to about 90:10.

2. The joint compound of claim 1, wherein the ratio, by weight, of antioxidant to stainless steel grit is in the range of from about 40:60 to about 70:30.

3. The joint compound of claim 2, wherein the ratio, by weight, of antioxidant to stainless steel grit is about 50:50.

4. The joint compound of claim 2, wherein the ratio, by weight, of antioxidant to stainless steel grit is about 43:57.

5. A joint compound for electrical connections, the compound comprising:

an antioxidant base material which comprises about 2 to about 10 percent copper flake, by weight; and a quantity of stainless steel grit mixed with the antioxidant base material.

6. A joint compound for electrical connections, the compound comprising:

an antioxidant base material; and a quantity of stainless steel grit mixed with the antioxidant base material, the quantity comprised of cut wire having a diameter within the range of from about 0.012 inches to about 0.125 inches.

7. The joint compound of claim 6, wherein the stainless steel grit has a diameter within the range of from about 0.012 inches to about 0.030 inches.

8. The joint compound of claim 7, wherein the stainless steel grit has a diameter of about 0.017 inches.

9. A joint compound for electrical connections, the compound comprising:

an oil based antioxidant based material that is a urethane polymer of castor oil; and a quantity of stainless steel grit mixed with the antioxidant based material.

10. A joint compound for electrical connections, the compound comprising:

an antioxidant base material comprised of urethane polymer of castor oil;

fumed silica as a thickener;

copper flake in a quantity of about 6.5%, by weight; and stainless steel cut wire shot having a diameter within the range of from about 0.012inches to about 0.030 inches, and in a quantity of about 57%, by weight, interspersed throughout the antioxidant base material.

* * * * *

UNITED STATES PATENT AND TRADEMARK OFFICE

CERTIFICATE OF CORRECTION

PATENT NO. : 7,906,046 B2
APPLICATION NO. : 12/062824
DATED : March 15, 2011
INVENTOR(S) : Robert L. Sokol et al.

It is certified that error appears in the above-identified patent and that said Letters Patent is hereby corrected as shown below:

Column 6, line 36 which reads "range of from about 0.012inches to about 0.030 inches" should read "range of from about 0.012 inches to about 0.030 inches."

Signed and Sealed this
Fifth Day of February, 2013

Teresa Stanek Rea
*Acting Director of the United States Patent and Trademark Office*